United States Patent [19]

Mühlberg

[11] 4,161,164

[45] Jul. 17, 1979

[54] INTERNAL COMBUSTION ENGINE FUEL SUPPLY SYSTEM

[75] Inventor: Erhard Mühlberg, Darmstadt-Eberstadt, Fed. Rep. of Germany

[73] Assignee: Siemens Aktiengesellschaft, Munich, Fed. Rep. of Germany

[21] Appl. No.: 582,473

[22] Filed: May 30, 1975

Related U.S. Application Data

[62] Division of Ser. No. 378,234, Jul. 16, 1973, abandoned.

[30] Foreign Application Priority Data

Jul. 17, 1972 [DE] Fed. Rep. of Germany ..... 2235004

[51] Int. Cl.[2] ..... F02M 31/00

[52] U.S. Cl. ..... 123/122 G; 123/179 H; 123/133; 123/3

[58] Field of Search ..... 123/122 G, 122 F, 179 H, 123/3, 1 A, 133

[56] References Cited

U.S. PATENT DOCUMENTS

| | | | |
|---|---|---|---|
| 1,064,086 | 6/1913 | Porter | 123/133 |
| 1,334,446 | 3/1920 | Good | 123/122 G |
| 1,448,682 | 3/1923 | Vincent | 123/122 G |
| 1,451,035 | 4/1923 | Woelson | 123/122 G |
| 1,609,296 | 12/1926 | Good | 123/122 G |
| 1,625,312 | 4/1927 | Good | 123/122 G |
| 1,637,104 | 7/1927 | Crone | 123/122 F |
| 3,024,777 | 3/1962 | Baker | 123/122 G |
| 3,828,736 | 8/1974 | Koch | 123/3 |
| 3,901,197 | 8/1975 | Noguchi | 123/3 |

*Primary Examiner*—Ronald H. Lazarus
*Attorney, Agent, or Firm*—Kenyon & Kenyon

[57] ABSTRACT

The method of operating an internal combustion engine which includes the steps of converting liquid hydrocarbon fuel to a soot-free gaseous fuel by means of partial combustion in a converter while supplying an oxygen-containing gas to the converter by means of a first branch line and a gas metering valve, supplying the gaseous fuel to the engine, and supplying combustion air to the engine by means of a throttle valve and a gas intake line to support combustion of the gaseous fuel. The improvement comprises the step of admixing, by means of a second fuel metering valve, liquid hydrocarbon fuel from a fuel supply tank with the gaseous fuel produced by the converter, subsequent to the step of converting and prior to the steps of supplying the gaseous fuel to the engine and supplying combustion air to the engine. The step of admixing further comprises admixing the liquid hydrocarbon fuel with the gaseous fuel by opening the second fuel metering valve to admix the liquid hydrocarbon fuel with the gaseous fuel when the throttle valve is fully opened.

6 Claims, 2 Drawing Figures

INTERNAL COMBUSTION ENGINE FUEL SUPPLY SYSTEM

This is a division of application Ser. No. 378,234 filed July 16, 1973, now abandoned.

BACKGROUND OF THE INVENTION

This invention relates to internal combustion engines of either the reciprocating or rotary piston types, particularly when used in automotive vehicle service, supplied with a liquid hydrocarbon or higher alcohol-type fuel and air mixture, usually ignited by an electrical spark, although possibly ignited by other means.

To reduce intensively the atmospheric pollution attributable to such an engine, the prior art has provided a converter which can be supplied with an air-conditioning gas and a liquid hydrocarbon fuel which may be of low-octane value and which, by partial combustion for heat and the use of a catalyzer and/or other means, is converted at relatively very low temperatures, i.e. at a temperature lower than the thermodynamic soot limit, to a gaseous fuel of high-octane value and forming products of a combustion which are either unobjectionable or not seriously objectionable as atmospheric pollutants, the converted gaseous fuel, for example, comprising carbon monoxide, methane, and possibly hydrogen.

That type of converter produces — in spite of the above mentioned relatively very low gasification temperature — the gaseous fuel at an elevated temperature compared to that of the engine's intake air and therefore of reduced density, i.e. of increased specific value. Also such a converter gasifying the liquid fuel by partial oxidation wastes fuel calories. Besides the temperature of the fuel gas/combustion air/mixture supplied to the engine increases substantially. These factors particularly reduce significantly the maximum output of the engine in comparison to that of the engine working in the conventional manner with a carburettor or an injection device for atomising the liquid fuel into the engine's air intake system. Further the fuel consumption is negative influenced by above mentioned factors.

The engine is, of course, provided with an air intake supply means including a throttle normally controlled by a foot pedal or accelerator, and the converter's liquid fuel and air supply means are adjusted automatically to provide the gaseous fuel in amounts for proper combustion in the engine for varying accelerator positions and simultaneously to provide a proper temperature for gasification the liquid fuel in said converter.

The engine can meet normal power demands but not those occasionally made, such as when an automobile or truck must pass another vehicle, climb steep inclines, etc.

SUMMARY OF THE INVENTION

An object of the present invention is to provide for retaining the advantages described above while permitting the development of the full or substantially full rated power of the engine.

This object is attained above all by an improvement wherein, generally speaking, means including a control valve, are provided for mixing liquid (hydrocarbon) fuel of the hydrocarbon or higher alcohol type with the gaseous fuel supplied by the converter to the engine, to provide the latter with an enriched fuel gas, when required. This control valve for the liquid fuel is controlled by means automatically responsive to the position of the engine's accelerator in such a manner that it preferably begins to be opened not before the throttle valve of the engine's supply is fully opened, i.e. the maximum power output of the engine driven with not enriched fuel gas is reached. By means described later the accelerator can override this position and proportional to the accelerator's override position the control valve is wider opened for an increasing amount of liquid fuel injected into the fuel gas. In other words, when the higher power range of which the engine is capable, is not required, the accelerator or foot pedal controls the throttle valve of the engine's supply up to its fully opening position, but when more power is needed, the accelerator in spite of the fully opened engine's throttle valve supply can be further depressed and by suitable means the mentioned fuel control valve is increasingly opened and so the liquid fuel taken from the fuel feed line of the converter is then mixed with or injected at an increasing rate into the maximum gaseous fuel output of the converter to produce a mixture properly proportioned relative to the then — as formerly described — increased air flow to obtain proper combustion within the engine and effective operation of the latter up to its maximum power.

The flow through the converter may be effected by an aspirator or jet-pump actuated by the air supply to the engine which is forced into the latter at relatively high velocity by the atmospheric pressure during the engine's intake cycles. In the case of an engine of a fuel-injection type, which has a higher power output and a lower fuel consumption, a compressor is used to produce the flow through the converter and to provide a pressure suitable for injection into the engine after the inlet valve etc. of the engine is closed. In this case, and possibly in all cases, a heat exchanger or water injection may be provided for removing heat from the gaseous fuel which leaves the converter at an elevated temperature, thus further enhancing the ability of the engine to produce its full rated horsepower output and in addition decreasing the specific fuel consumption of the engine. Both advantages are enlarged if this compressor is driven by an exhaust turbine. Said advantages are furthermore increased, if the air fed into the converter is heated by an exhaust heat exchanger.

BRIEF DESCRIPTION OF THE DRAWINGS

Preferred embodiments of the present invention are illustrated entirely in diagram form by the accompanying drawings in which.

DESCRIPTION OF THE PREFERRED EMBODIMENTS

Figure 1:
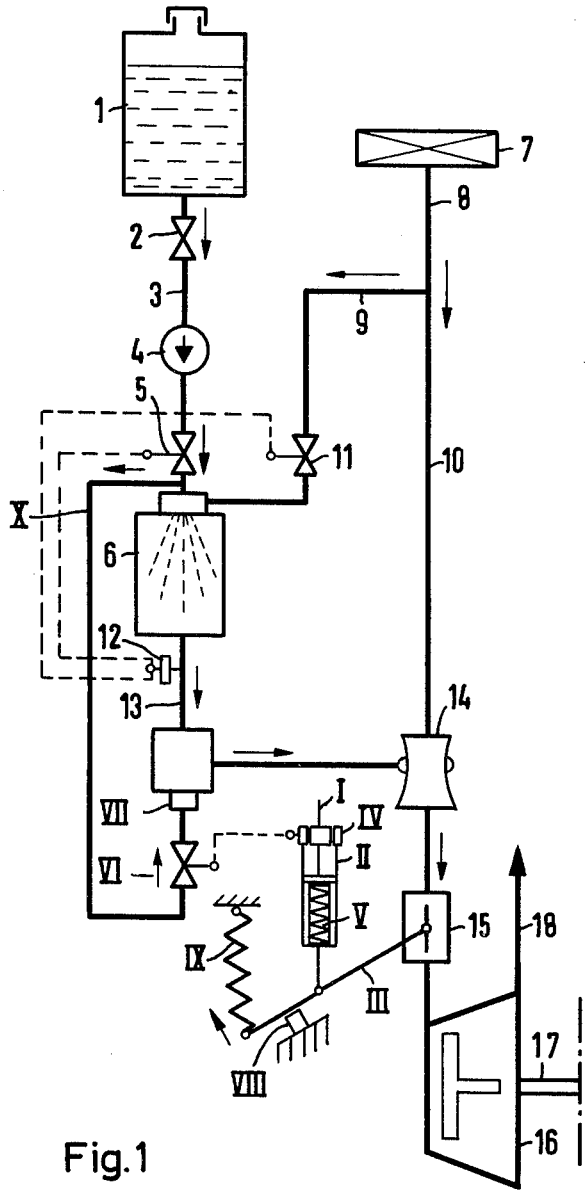
FIG. 1 shows a first embodiment.

The embodiment shown by FIG. 1 is relatively simple and inexpensive and may be used in the case of an automotive vehicle engine, for example, of the type normally using a standard carburettor and intake manifold. In this FIG. 1, the liquid fuel in the supply tank 1 feeds through what may be a manually operated fuel cock 2, via a fuel line 3 to a fuel pump 4 which introduces it at a pressure sufficient for good atomising through a fuel metering valve 5 of the remote-controlled type, into the converter 6 of the type previously described. For the partial combustion of the liquid fuel in the converter 6 where it is introduced as in atomized form, air sucked in through an air cleaner 7, is fed into the converter 6 via a line 8 and branch line 9, the line 8 in this instance being a part of the engine's air intake line 10. The amount of air required for the partial combustion in the converter 6 is regulated by a remote control air metering valve 11 in the line 9 going to the converter. The converter contains a catalyst and/or other known means for a relatively very low gasification temperature which at elevated temperatures converts the liquid fuel to the gaseous fuel.

In what may be a prior art manner, the temperature of the output of the converter 6 is sensed by a temperature sensor 12 linked or connected, as indicated by the broken lines, to the liquid flow metering valve 5 and the air flow metering valve 11, teh arrangement being such as to keep a proper ration between the two fluids as required for proper operation of the converter 6 during its varying outputs. The gaseous fuel output of the converter 6 is sucked via the line 13, by an aspirator 14 powered by the flow of the intake air sucked through the intake pipe line 10 by the engine when the pressure in its combustion chamber or chambers, during intake cycles, reduces to below atmospheric pressure. The aspirator 14 maintains a pressure differential between the branch line 9 supplying the converter 6 and the latter's output line 13, thus causing flow through the converter 6.

A throttle valve 15, such as is normally operated by a foot pedal or accelerator, controls the intake of the internal combustion engine 16. The aspirator 14 functions not only to provide flow through the converter 6, but also to mix the converter's gaseous flow output with the air drawn in through the intake line 10. As the throttle valve 15 is opened, the air flow through the line 10 to the engine increases, the aspirator 14 accelerates the flow through the converter 6 while the sensor 12 in this case automatically controls the metering valves 5 and 11 to increase the flow of the liquid fuel and air to the converter in, of course, the proper proportions required for the converter 6 to produce the gaseous fuel.

The converter 6 is miniaturized so it can be put into the engine compartment of an automotive vehicle. The gaseous fuel leaves the converter 6 at an elevated temperature, thus — in consequence of an increased temperature of the mixture of the intake air and said gaseous fuel, and in addition in consequence of the volume taken from the intake air by the gaseous fuel in said mixture — the mass of the cylinder charge and therewith the maximum power output is reduced in comparison to that obtained when the engine is working in the conventional manner, i.e. with liquid fuel mixed into the intake air by means of a carburettor or an injection device. A further reduction of the output and in addition an increasing fuel consumption is existent because the heat created by the partial oxidation of the liquid fuel in the converter for the purpose of its gasifying is thermodynamically lost for the engine. This has the consequence of a corresponding lower caloric value per mass unit of the air/gaseous fuel-mixture than that of the air/liquid fuel-mixture used in above mentioned conventional engine. However, under normal driving conditions, the engine 16 is provided with an adequate charge of gaseous fuel and air.

As it is illustrated in FIG. 1, the engine's intake throttle valve 15 is fully opened by its actuating rod I, which on the one hand is connected with the not shown accelerator pedal actuated by the driver, and on the other hand is connected via an elastic connection member II, containing at its upper end the accelerator's position giving transducer IV and its lower end a spring V with the lever III of the throttle valve 15. In the shown position, the accelerator pedal is fully depressed and, therefore, the transducer's movable solenoid is fully positioned within the induction coil and thus producing a signal transmitted, as indicated by broken lines, to a remote-controlled metering valve VI introducing the highest possible amount of the liquid fuel via an injection device VII to the gaseous fuel leaving the converter 6 via the line 13 which goes to the device VII. Thus, a maximum enrichment of the gaseous fuel and therewith a maximum output of the engine is provided. The system is, for instance, designed so that the fuel metering valve VI only begins to open when the engine has reached its maximum output at using only gaseous fuel, i.e. when the intake throttle valve 15 of the engine 16 is fully opened. At this moment, the stop VIII for the lever III is not yet reached and the accelerator pedal is not fully depressed, i.e. also has not reached its not shown stop.

The amount of liquid fuel injected into the gaseous fuel increases as the accelerator pedal is further depressed. As described above, the molecules of the injected fuel preferably is cracked by the sensible heat of the gaseous fuel, changing thereby to smaller molecules of a relatively very low boiling point and — most important — of a high octane number.

The intake throttle valve return spring is shown at IX and its elasticity and that of the spring V should be interrelated so that the sensor IV does not start to operate until the engine 16 has reached its full power with the pure gaseous fuel. The valve VI is supplied with the liquid fuel by way of a branch line X branched off from the liquid fuel feed line 3 of the converter 6, and that after the main fuel metering valve was actuated by the temperature sensor for the gaseous fuel at the converter's outlet. Thus, it can be seen that the liquid fuel supplied for enrichment of the gaseous fuel, when demanded, is the same as the liquid fuel fed to the converter 6. This would ordinarily be a low-cost hydrocarbon liquid of low-octane value, but its knocking or preignition characteristic and its atmosphere pollution potentiality are diminished (1) by the fact that a major amount of the fuel supplied to the engine 16 is the output of the converter 6 even when the engine 16 is operating under full-load conditions demanding a maximum fuel enrichening and (2) by the above mentioned effect of cracking.

Figure 2:
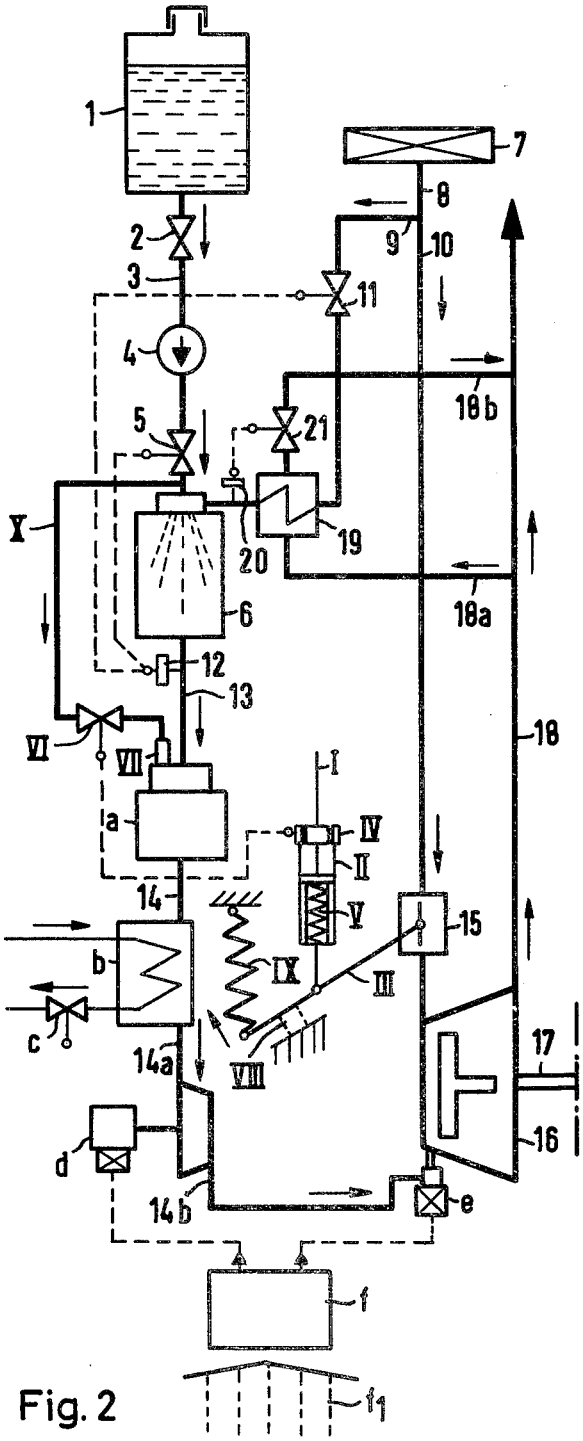
FIG. 2 shows a second embodiment.

Referring to FIG. 2 showing a more advantageous but also more complex embodiment of the invention as used for a fuel injection engine, where for components corresponding to those shown by FIG. 1 the same numerals are used.

The difference in this case is that the output of the converter 6 and the enrichening liquid fuel are fed together to a cracking reactor a, where — eventually with the aid of a suitable catalyst — the liquid fuel may be converted partially or wholly to a crack gas. Another difference is that the fuel gas-mixture leaving the reactor a goes through a heat exchanger b provided with a coolant under the control of a valve c, abstracting some of the heat from the air/fuel gas-mixture and increasing its density, respectively decreasing its specific volume and thereby increasing the charge and output of the engine, the cooled fluid via a compressor d, being compressed or pressurized so that it can be injected via an injection valve e to the motor 16, the latter being of the electronic fuel-injection type as previously noted, which is characterized by controlling the opening time of the injection valve as a function of the engine's condition in respect to load and speed and the conditions of the atmosphere and the temperature level of the engine. For reasons of a particularly intensive exhaust decontamination it should be provided a leaning out of the mixture of gaseous fuel and engine's combustion air, as far as possible, in respect of maximum output, fuel consumption and driveability.

In this instance, the compressor functions to effect the flow through the converter 6 and the cracking reactor a by suction, as well as to apply the necessary pressure for injection direction into the engine after its inlet valve is closed. This pressure may be kept constant. If the compressor d is powered by an electric motor, by means of a prior art electronic control system f in which the desired pressure is entered as information in the form of a control quantity $f_1$. This would be analogous to the control used by a liquid gasoline engine using electronic fuel injectors.

The heat required for gasifying the liquid fuel in the converter 6 requires quasi combustion of some of the liquid fuel and the amount of this fuel so required is lost insofar as engine output and fuel consumption, too, is concerned. To reduce this loss, the engine's exhaust pipe 18 has a branch line leaving the pipe at 18*a* and returning at 18*b*, which goes through a heat exchanger 19 through which the air intake to the converter is passed for preheating, thus reducing the amount of liquid fuel required to be burned for the gasifying reactions to be effective. A temperature sensor 20, using a prior art system indicated by broken lines, renders a valve 21 responsive to the temperature of the preheated air fed to the converter, this valve 21 controlling the exhaust flow rate through the heat exchanger 19.

What is claimed is:

1. In a method of operating an internal combustion engine, said engine including a fuel supply tank for receiving a liquid hydrocarbon fuel, a fuel line coupled to said fuel supply tank, a gas intake line, a throttle valve coupled to said engine and to said gas intake line, a converter for converting said liquid hydrocarbon fuel to a soot-free gaseous fuel by means of partial combustion, a first branch line coupled to said gas intake line, a gas metering valve coupled to said first branch line and to said converter, a first fuel metering valve coupled to said fuel line and said converter, an injection device coupled to said converter, a second branch line coupled to said fuel line between said fuel metering valve and said converter, and a second fuel metering valve coupled to said second branch line and to said injection device, said method including the steps of converting said liquid hydrocarbon fuel to a soot-free gaseous fuel by means of partial combustion in said converter while supplying an oxygen-containing gas to said converter by means of said first branch line and said gas metering valve, supplying said gaseous fuel to said engine, and supplying combustion air to said engine by means of said throttle valve and said gas intake line to support combustion of said gaseous fuel, the improvement comprising the step of admixing, by means of said second fuel metering valve, liquid hydrocarbon fuel from said fuel supply tank with said gaseous fuel produced by said converter, subsequent to said step of converting and prior to said steps of supplying said gaseous fuel to said engine and supplying said combustion air to said engine, said step of admixing further comprising admixing said liquid hydrocarbon fuel with said gaseous fuel by opening said second fuel metering valve to admix said liquid hydrocarbon fuel with said gaseous fuel when said throttle valve is fully opened.

2. The method recited in claim 1, wherein said engine further comprises an aspirator coupled to said throttle valve, said gas intake line, and to said injection device for supplying combustion air to said engine to support combustion of said gaseous fuel produced by said converter, wherein said oxygen-containing gas comprises air, and wherein said method further comprises the step of mixing said combustion air with said gaseous fuel subsequent to said step of admixing by means of said aspirator, thereby supplying a mixture of said gaseous fuel and combustion air to said engine through said throttle valve.

3. The method recited in claim 1, wherein said engine further comprises a cracking reactor coupled to said injection device and to said converter, and wherein said method further comprises the step of adjusting the temperature and flow velocity of said gaseous fuel and the flow velocity of said liquid hydrocarbon fuel so that said liquid hydrocarbon fuel is completely cracked, without the formation of soot, into a lower-molecular fuel in said cracking reactor.

4. The method recited in claim 3, wherein said engine further comprises a first heat exchanger coupled to said cracking reactor, and wherein said method further comprises the step of cooling said gaseous fuel produced by said converter in said heat exchanger subsequent to said step of admixing.

5. The method recited in claim 4, wherein said engine further comprises a compressor coupled to said heat exchanger and an injection valve coupled to said compressor, and wherein said method further comprises the step of producing pressure on said gaseous fuel produced by said converter subsequent to said steps of admixing and cooling by means of said compressor and injecting said gaseous fuel into said engine by means of said injection valve subsequent to said step of producing pressure.

6. The method recited in claim 5, wherein said engine further comprises an exhaust pipe, third and fourth branch lines coupled to said exhaust pipe, and a second heat exchanger coupled to said gas metering valve and to said converter and to said third and fourth branch lines and wherein said method further comprises the step of heating said oxygen-containing gas supplied to said converter in said second heat exchanger by means of exhaust gases produced by said engine flowing through said third and fourth branch lines and said second heat exchanger.

* * * * *